US011717864B2

(12) United States Patent
Soemoto et al.

(10) Patent No.: US 11,717,864 B2
(45) Date of Patent: Aug. 8, 2023

(54) CLEANER APPARATUS FOR STEEL PLATE

(71) Applicant: TAKUSYO CO., LTD., Takatsuki (JP)

(72) Inventors: Kazuhiko Soemoto, Osaka (JP); Hiroshi Uzawa, Izumi (JP)

(73) Assignee: TAKUSYO CO., LTD., Takatsuki (JP)

( * ) Notice: Subject to any disclaimer, the term of this patent is extended or adjusted under 35 U.S.C. 154(b) by 276 days.

(21) Appl. No.: 17/073,692

(22) Filed: Oct. 19, 2020

(65) Prior Publication Data

US 2021/0402447 A1 Dec. 30, 2021

(30) Foreign Application Priority Data

Jun. 25, 2020 (JP) ..... 2020-109808

(51) Int. Cl.

| | |
|---|---|
| ***B08B 7/04*** | (2006.01) |
| ***A46B 13/00*** | (2006.01) |
| ***A46B 13/02*** | (2006.01) |
| ***B08B 1/00*** | (2006.01) |
| ***B08B 1/02*** | (2006.01) |
| ***B08B 1/04*** | (2006.01) |

(52) U.S. Cl.

CPC ..... *B08B 7/04* (2013.01); *A46B 13/001* (2013.01); *A46B 13/02* (2013.01); *B08B 1/002* (2013.01); *B08B 1/006* (2013.01); *B08B 1/02* (2013.01); *B08B 1/04* (2013.01); *A46B 2200/30* (2013.01)

(58) Field of Classification Search

CPC .. B21D 43/08; B08B 7/04; B08B 1/04; B08B 1/02; B08B 1/006; A46B 2200/30; A46B 13/02; A46B 13/001

USPC ..... 15/4

See application file for complete search history.

(56) References Cited

FOREIGN PATENT DOCUMENTS

JP 6300867 B2 * 3/2018 ..... B08B 1/002
JP 6300867 B2 3/2018

* cited by examiner

*Primary Examiner* — Katina N. Henson
(74) *Attorney, Agent, or Firm* — Kratz, Quintos & Hanson, LLP

(57) ABSTRACT

In a cleaner apparatus for steel plate provided with a brush roll 1 driven to rotate to remove foreign matter D from a surface Wa of a steel plate W to be conveyed, a magnet bar 3 to attract iron powder d among the foreign matter D stuck to the brush roll 1 by magnetic force, a wiping cloth 5 disposed between the brush roll 1 and the magnet bar 3 to remove the foreign matter D attracted by the magnet bar 3; the wiping cloth 5 of belt shape is disposed parallel to an axis $L_1$ of the brush roll 1.

4 Claims, 2 Drawing Sheets

CLEANER APPARATUS FOR STEEL PLATE

1. FIELD OF THE INVENTION

This invention relates to a cleaner apparatus for steel plate.

2. DESCRIPTION OF THE RELATED ART

Conventionally, a cleaner apparatus for steel plate, for removing iron powder stuck to a conveyed steel plate, provided with a supply reel to supply a belt-shaped cloth to wipe iron powder stuck to a brush roll to remove iron powder from a steel plate, and a winding reel to wind the belt-shaped cloth, is known (refer to Japanese Patent No. 6300867).

The cleaner apparatus for steel plate disclosed by Japanese Patent No. 6300867, as shown in FIG. 4 and FIG. 5, has a construction in which a brush roll 46 driven to rotate is made contact with an upper face of a steel plate 43 for dust removal.

A wiping cloth 45, having a width dimension slightly larger than the length dimension of the brush roll 46, is used. That is to say, the wiping cloth 45 of a width dimension $W_{45}$, larger than a length dimension of the brush roll 46, namely, a width dimension $W_{43}$, of the steel plate 43, must be used because a supply reel 41 and a winding reel 42 are made parallel to an axis of the brush roll 46, and disposed on an upper position, and, the wiping cloth 45 is suspended on a magnet bar 44 disposed as to correspond to side faces of the upstream side of the brush roll 46 as to be U-shape (V-shape) for dust removal.

Recently, a method to mold a body of an automobile with one press work has been in practice, the width dimension $W_{43}$ of the steel plate 43 is several meters in some cases. Therefore, the width dimension $W_{45}$ of the wiping cloth 45 also has to be several meters.

As described above, the wiping cloth 45 of the large width dimension $W_{45}$, has problems such as (i) the wiping cloth 45 is difficult to obtain and expensive, (ii) it is not easy to change the supply reel 41 and the winding reel 42 disposed on the upper position of the conveying way, further, foreign matter is scattered to pollute the steel plate 43 and the conveying way below when the wiping cloth 45, wound by the winding reel 42 after dust removal (usage), is changed.

Therefore, it is an object of the present invention to provide a cleaner apparatus for steel plate with which a wiping cloth of standard size (width dimension) on the market can be used, the apparatus can correspond to steel plates of different widths with a cloth of the same size, removal efficiency of foreign matter can be increased, the cloth after use can be easily and swiftly changed, and entire working efficiency can be improved.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
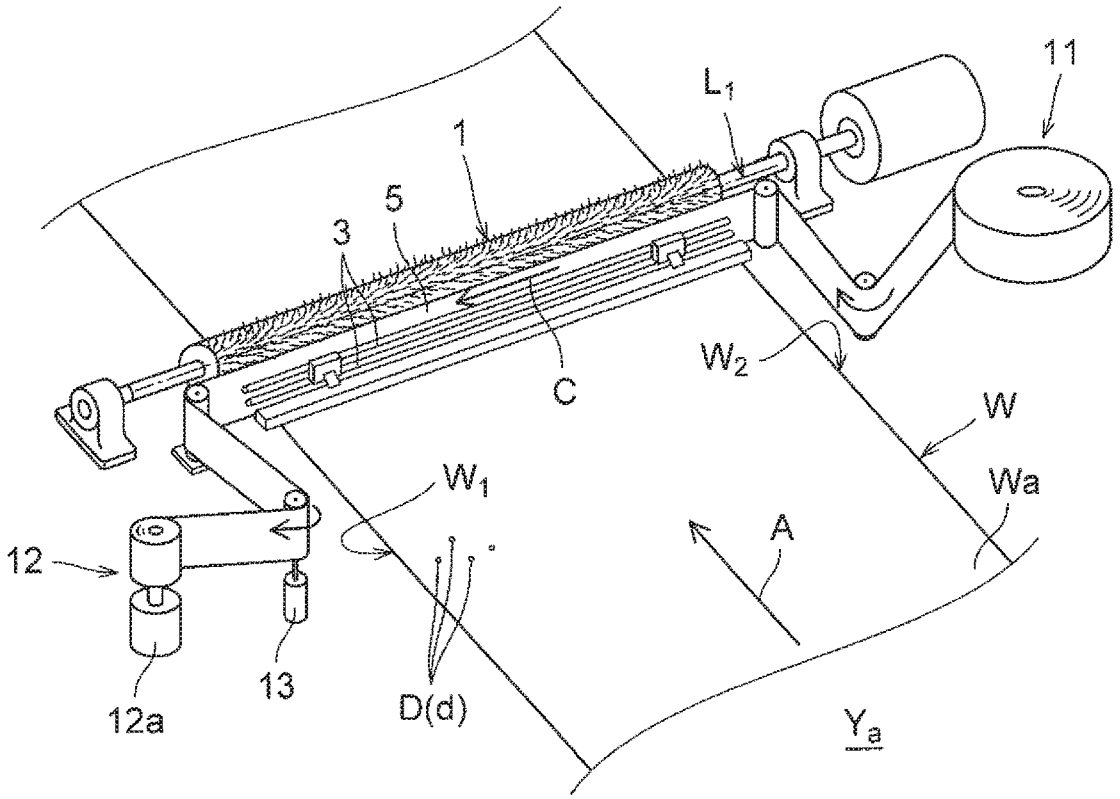
FIG. 1 is a schematic perspective view showing an embodiment of a cleaner apparatus for steel plate of the present invention.
Figure 2:
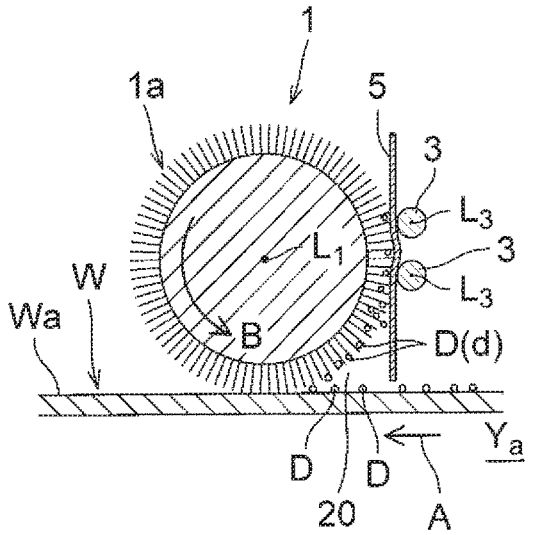
FIG. 2 is a cross-sectional side view of a principal portion.

FIG. 1 and FIG. 2 show an embodiment of a cleaner apparatus for steel plate of the present invention. This cleaner apparatus for steel plate is provided with a brush roll 1 driven to rotate to remove foreign matter D from a surface Wa of a conveyed steel plate W, two magnet bars 3 disposed parallel as to attract and remove iron powder d among the foreign matter D stuck to the brush roll 1 by magnetic force, and a wiping cloth 5 (also called the cloth 5 below) disposed between the brush roll 1 and the magnet bars 3, and sent parallel to a (rotational) axis $L_1$ of the brush roll 1.

An axis $L_3$ of each of the magnet bars 3 is disposed parallel to the (rotational) axis $L_1$ of the brush roll 1, and on an upstream side Ya to the rotational axis $L_1$ in conveying direction of the steel plate. The brush roll 1 is driven to rotate in a direction shown with an arrow B by a driving device 7 composed of a motor, a reducer, etc.

The wiping cloth 5 is to contact the brush roll 1 for removing the foreign matter D, removed from the surface Wa of the steel plate, from the brush roll 1.

That is to say, the wiping cloth 5 gathers iron powder d attracted from the brush roll 1 by magnetic force of the magnet bars 3, and wipes all foreign matter D including the iron powder d, dust, oil, etc.

The cloth 5 is formed belt-shaped with woven, knitted, unwoven cloths or combination of them using synthetic fibers such as polyester, polyethylene, nylon, etc. to certainly gather the foreign matter D.

The cloth 5 is disposed parallel to the axis $L_1$ of the brush roll 1. That is to say, the cloth 5 is sent parallel to each of the magnet bars 3, namely, sent in a direction C at right angles with the conveying direction of the steel plate W shown with an arrow A. Therefore, the width of the cloth 5 may be approximately same as the diameter of the brush roll 1, preferably, the vertical dimension (width) of the cloth 5 is slightly larger than the diameter of the brush roll 1. Even if the width of the steel plate W, from which the foreign matter D should be removed, is changed, it is not necessary to change the vertical dimension (width) of the cloth 5, the cloth 5 does not need to be changed to clean a steel plate W of different width, and working efficiency can be improved.

The two magnet bars 3 are disposed apart for a predetermined interval, pressed to the brush roll 1 through the cloth 5 as to make the cloth 5 in area contact with the brush roll 1. The cloth 5 is in area contact with a peripheral face 1*a* of the brush roll 1 along the arc between the two magnet bars 3 because the two magnet bars 3 are disposed vertically apart (refer to FIG. 2).

Gathering area of the foreign matter D is large in comparison with a case of one magnet bar 3 (conventional apparatus) and foreign matter removing ability from the brush roll 1 is improved for the area contact state because the magnet bars 3 are pressed to the brush roll 1 through the cloth 5 with a certain size of area. Further, gathering ability of the iron powder d is improved because magnetic field is formed also in a space between the parted two magnet bars 3.

The cloth 5 is sent and wound by a supply roll 11 and a winding roll 12. The winding roll 12 is driven to rotate by a winding drive portion 12*a* such as a motor. The supply roll 11, the winding roll 12, and the winding drive portion 12*a* are disposed on positions out of the side of the brush roll 1. That is to say, they are disposed on positions outside of left and right side ends $W_1$ and $W_2$ of the conveyed steel plate W.

Figure 4:
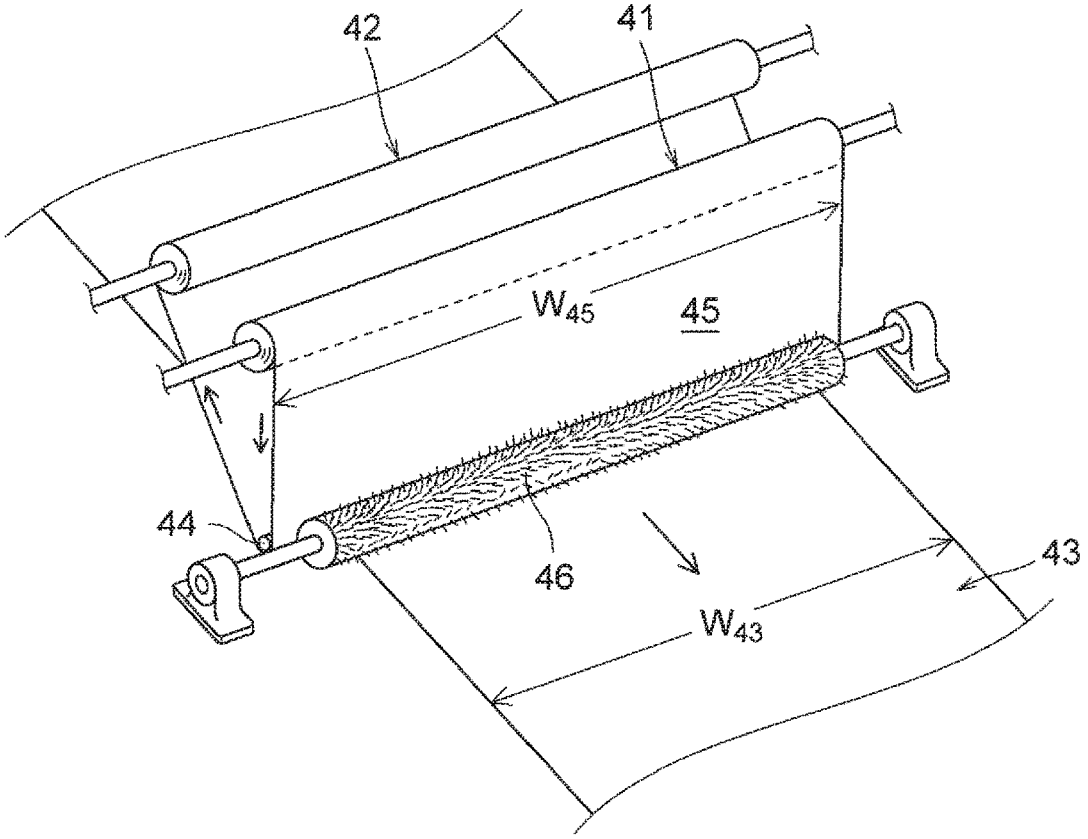
FIG.4 PRIOR ART
FIG. 4 is a perspective view showing a conventional example.
Figure 5:
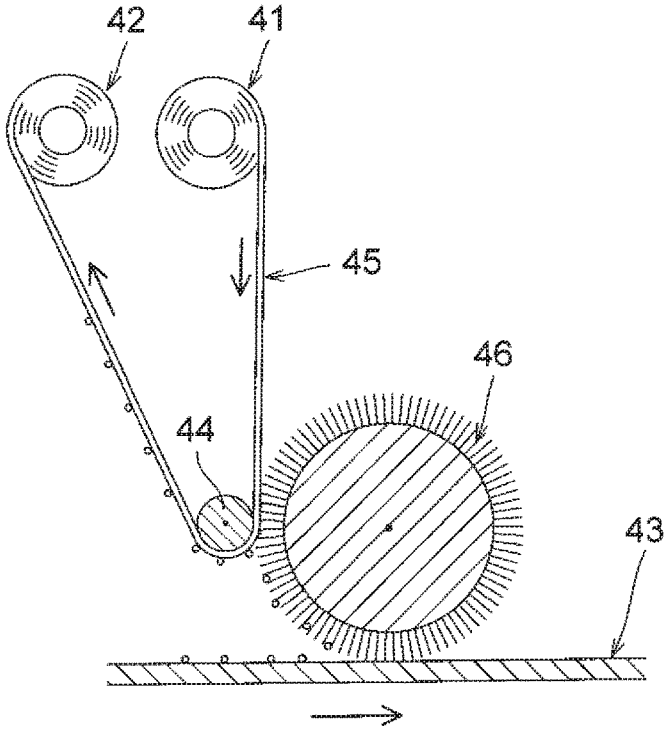
FIG.5 PRIOR ART
FIG. 5 is a cross-sectional side view of a principal portion showing the conventional example.

Although in the conventional apparatus, in which the supply reel and the winding reel are disposed on the conveying line of the steel plate as shown in FIG. 4 and FIG. 5, much labor and time are required to change the cloth, the cloth 5 can be easily and swiftly changed with the above construction of the present invention.

In the foreign matter removal work, sending method and sending speed of the cloth 5 can be freely adjusted considering the width of the steel plate W, sticking condition of the foreign matter D, etc. For example, the cloth 5 is sent continuously or intermittently.

In case that the cloth 5 is sent intermittently, an encoder 13 is disposed near the winding roll 12 to measure the sending amount to send the cloth 5 intermittently as to correspond to preliminarily set conveying distance of the steel plate W.

When the cloth 5 is sent intermittently, it is preferable to move the magnet bars 3 pressing the cloth 5 slightly backward in a direction parting from the cloth 5 (namely, in an opposite direction to the arrow A).

And, as clearly shown in FIG. 2, the cross section of the cloth 5 is "I-shaped" having an arc-shaped portion (along the peripheral face 1*a* of the brush roll 1) on a middle position between the upper and lower two magnet bars 3. In FIG. 1 and FIG. 2, the "I-shaped" cloth 5 is disposed on an upstream side in the conveying direction of the steel plate W, the foreign matter D is mainly gathered in a space portion 20 triangular in cross section surrounded by the brush peripheral face 1*a*, the surface Wa of the steel plate, and the cloth 5 (shown in FIG. 2) when the brush roll 1 rotates in the arrow B direction, and the foreign matter D is sent out by the cloth 5 in a direction at right angles with the surface of FIG. 2.

Figure 3:
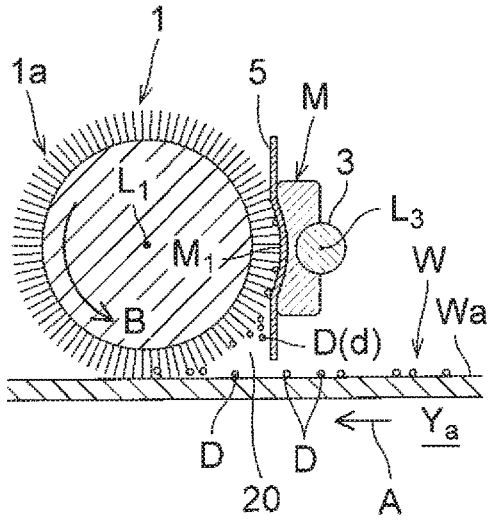
FIG. 3 is a cross-sectional side view of a principal portion showing another embodiment.

FIG. 3 shows another embodiment of the present invention.

In the embodiment of FIG. 3, the magnet bar 3 is one, and diameter of the magnet bar 3 is larger than that of the magnet bar 3 in the embodiment of FIG. 1 and FIG. 2.

Further, a magnetic long body M is disposed between the brush roll 1 and the magnet bar 3 (through the cloth 5).

The magnetic long body M is metal which can be magnetic, for example, carbon steel is appropriate.

A center portion of the magnetic long body M has a shallow concave groove $M_1$ of concave face having a curvature approximately same as the curvature of the peripheral face 1*a* of the brush roll 1, and the cloth 5 is deformed along the concave face of the shallow concave groove $M_1$ to follow the brush roll 1. That is to say, the cloth 5 can be made contact the peripheral face 1*a* as an arc corresponding to the peripheral face 1*a* of the brush roll 1, and removal effect of the foreign matter D can be enhanced thereby. Other constructions, working, and functions are same as FIG. 2.

The present invention is modifiable, for example, the diameter, strength of the magnetic force, etc. of the magnet bar 3 can be freely changed and adjusted considering the state of the surface of the steel plate W to be cleaned, amount of the foreign matter D, etc.

With the present invention as described above in detail, the wiping cloth 5 of rather small width dimension (for general use) can be sufficient to use because in the cleaner apparatus for steel plate provided with the brush roll 1 driven to rotate to remove foreign matter D from the surface Wa of the steel plate W to be conveyed, the magnet bar 3 to attract iron powder d among the foreign matter D stuck to the brush roll 1 by magnetic force, the wiping cloth 5 disposed between the brush roll 1 and the magnet bar 3 to remove the foreign matter D attracted by the magnet bar 3, the wiping cloth 5 of belt shape is disposed parallel to the axis $L_1$ of the brush roll 1. The wiping cloth 45 of special large width dimension W, (refer to FIG. 4) is not necessary. And, the magnet bars 3 are easily set, and easily moved in the opposite direction to the arrow A (for the sufficient space as shown in FIG. 1) when the wiping cloth 5 (intermittently sent) is parted from the brush roll 1 (mechanism for the movement is not shown in FIG. 1).

And, removal effect of foreign matter is increased because two magnet bars 3, disposed parallel to the axis $L_1$ of the brush roll 1, are provided, and, the cross-sectional configuration of the wiping cloth 5 is arc-shaped corresponding to the peripheral face 1*a* of the brush roll 1 as to contact the peripheral face 1*a*. Further, gathering ability of the iron powder d is improved because magnetic field is formed also in the space between the parted two magnet bars 3.

And, the cloth 5 is widely in area contact with the brush roll 1, and removal effect of the foreign matter D can be enhanced because the magnet bar 3 is disposed parallel to the axis $L_1$ of the brush roll 1, the magnetic long body M is disposed between the wiping cloth 5 and the magnet bar 3, and, the magnetic long body M has the shallow concave groove $M_1$ of arc-shaped cross section to make the cross-sectional configuration of the wiping cloth 5 arc-shaped corresponding to the peripheral face 1*a* of the brush roll 1 as to contact the peripheral face 1*a*.

And, the cloth 5 can be easily and swiftly changed, and entire working efficiency can be improved because the supply roll 11 to supply the belt-shaped wiping cloth 5, and, the winding roll 12 and the winding drive portion 12*a* to wind the wiping cloth 5, are disposed on positions outside of left and right side ends $W_1$ and $W_2$ of the conveyed steel plate W. Especially, the foreign matter D stuck to the wiping cloth 5 wound around the winding roll 12 does not stick again on the conveying way or the steel plate W.

While preferred embodiments of the present invention have been described in this specification, it is to be understood that the invention is illustrative and not restrictive, because various changes are possible within the spirit and indispensable features.

What is claimed is:

1. A cleaner apparatus for steel plate provided with a brush roll driven to rotate to remove foreign matter from a surface of a steel plate to be conveyed, at least one magnet bar to attract iron powder among the foreign matter stuck to the brush roll by magnetic force, a wiping cloth disposed between the brush roll and the magnet bar to remove the foreign matter attracted by the magnet bar; comprising a construction in which:

the wiping cloth of belt shape is disposed and travels at a direction substantially parallel to or along an axis of the brush roll.

2. The cleaner apparatus for steel plate as set forth in claim 1, wherein two magnet bars, disposed parallel to the axis of the brush roll, are provided, and, a cross-sectional configuration of the wiping cloth is arc-shaped corresponding to a peripheral face of the brush roll as to contact the peripheral face.

3. The cleaner apparatus for steel plate as set forth in claim 1, wherein the magnet bar is disposed parallel to the axis of the brush roll, a magnetic long body is disposed between the wiping cloth and the magnet bar, and, the magnetic long body has a shallow concave groove of arc-shaped cross section to make a cross-sectional configuration of the wiping cloth arc-shaped corresponding to a peripheral face of the brush roll as to contact the peripheral face.

4. The cleaner apparatus for steel plate as set forth in claim 1, wherein a supply roll to supply the belt-shaped wiping cloth, and, a winding roll and a winding drive portion to wind the wiping cloth, are disposed on positions outside of left and right side ends of the conveyed steel plate.

* * * * *